US005263845A

United States Patent [19]

Warren

[11] Patent Number: 5,263,845

[45] Date of Patent: Nov. 23, 1993

[54] SPINNERETTE PLATE FOR THE MANUFACTURE OF MULTILOBAL FIBERS WITH PROJECTIONS ON EACH LOBE

[75] Inventor: Elbert K. Warren, Candler, N.C.

[73] Assignee: BASF Corporation, Parsippany, N.J.

[21] Appl. No.: 967,002

[22] Filed: Oct. 27, 1992

[51] Int. Cl.[5] ..... B29C 47/00

[52] U.S. Cl. ..... 425/461; 264/177.1; 264/177.13; 425/464; 428/397

[58] Field of Search ..... 264/177.1, 177.13; 425/461, 464; 428/364, 397, 401

[56] References Cited

U.S. PATENT DOCUMENTS

| | | | |
|---|---|---|---|
| 2,945,739 | 7/1960 | Lehmicke | 425/461 |
| 3,109,195 | 11/1963 | Combs et al. | 425/464 |
| 4,179,259 | 12/1979 | Belitsin et al. | 425/461 |
| 4,392,808 | 7/1983 | Phillips | 264/177.13 |
| 5,057,368 | 10/1991 | Largman et al. | 264/177.13 |
| 5,108,838 | 4/1992 | Tung | 264/177.13 |

FOREIGN PATENT DOCUMENTS

| | | | |
|---|---|---|---|
| 280998 | 11/1964 | Australia | 264/177.13 |
| 430441 | 6/1926 | Fed. Rep. of Germany | 425/461 |
| 1931741 | 3/1971 | Fed. Rep. of Germany | 425/461 |
| 37-14413 | 9/1962 | Japan | 425/461 |
| 45-2769 | 1/1970 | Japan | 264/177.13 |
| 9012130 | 10/1990 | World Int. Prop. O. | 425/461 |

*Primary Examiner*—Scott Bushey

[57] ABSTRACT

Described is a spinnerette plate for the manufacture of multilobal fibers which at least has one opening having a plurality of lobes, each lobe having two ends, one end being connected to the other lobes, the other end of each the lobes radiating outwardly and each lobe having a plurality of projections alternating along the contour of each lobe.

17 Claims, 2 Drawing Sheets

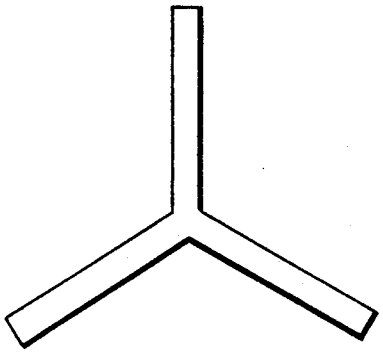
FIG. 1
PRIOR ART
FIG. 1a
PRIOR ART
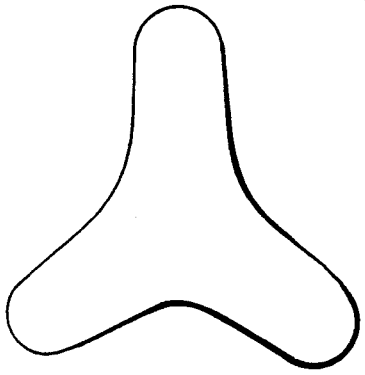
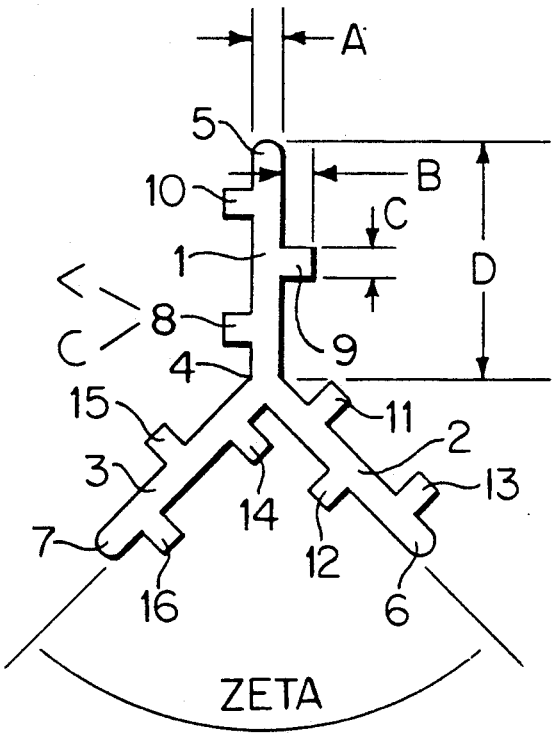
FIG. 2

SPINNERETTE PLATE FOR THE MANUFACTURE OF MULTILOBAL FIBERS WITH PROJECTIONS ON EACH LOBE

FIELD OF THE INVENTION

The present invention is directed to a spinnerette plate for the manufacture of a multilobal fiber with at least one opening having a plurality of lobes radiating outwardly and each lobe having a plurality of projections alternating along the contour of each lobe.

BACKGROUND OF THE INVENTION

Spinnerette plates for the manufacture of multilobal, in particular trilobal fibers and filaments are known in the art and have been widely used. Fibers manufactured by such spinnerettes show superior properties in bulk and covering power over fibers having round cross sections.

U.S. Pat. No. 3,109,195 discloses a spinnerette plate for the spinning of filaments having multi-lobed transverse cross-sections.

U.S. Pat. No. 3,194,002 discloses a multifilament yarn having a non-regular Y-shaped cross section.

U.S. Pat. No. 4,648,830 discloses a spinnerette for producing hollow trilobal cross-section filaments.

U.S. Pat. No. 5,108,838 discloses the trilobal and tetralobal filaments exhibiting low glitter and high bulk. The filaments having substantial convex curves.

Disadvantage of the filaments manufactured by spinnerette plates of the prior art are high luster and high sparkles.

Object of the present invention was to provide a spinnerette plate with a simple geometry, which is easy to produce and which allows the manufacture of a fiber which exhibits good bulk, subdued luster, uneven surface, and good soil hiding properties.

SUMMARY OF THE INVENTION

The objects of the present invention could be achieved by a spinnerette plate for the manufacture of multilobal fibers comprising at least one opening having a plurality of lobes, each lobe having two ends, one end being connected to the other lobes, the other end of each said lobes radiating outwardly and each lobe having a plurality of projections alternating along the contour of each lobe.

DESCRIPTION OF THE FIGURES

FIG. 1 is a front view of a trilobal spinnerette capillary of the prior art.

FIG. 1*a* is a cross-sectional view of a fiber spun by a spinnerette shown in FIG. 1.

FIG. 2 is a front view of a trilobal spinnerette capillary of the present invention comprising three alternating projections along the contour of each lobe. These projections may be of a specific shape such as a rectangular, square, triangular or round shape as shown in FIG. 2 under (8).

DETAILED DESCRIPTION OF THE INVENTION

Figure 2A:
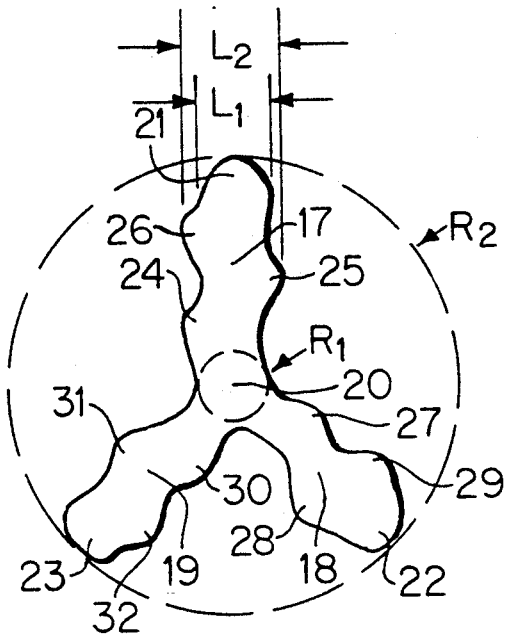
FIG. 2*a* is a cross-sectional view of a fiber spun by a spinnerette shown in FIG. 2.

The spinnerette plate of the present invention is suitable for the manufacture of fibers by melt spinning of a fiber forming polymer.

Suitable polymers for the manufacture of the fibers according to the present invention are all fiber forming thermoplastic materials especially polyamides, polyesters, and polyolefins. Suitable polyamides are nylon 6, nylon 6/6, nylon 6/9, nylon 6/10, nylon 6/12, nylon 11, nylon 12, copolymers thereof and mixtures thereof.

Preferred polyamides are nylon 6 and nylon 6/6. A suitable polyester is polyethylene terephthalate.

Various additives may be added to the respective polymer. These include, but are not limited to, lubricants, nucleating agents, antioxidants, ultraviolet light stabilizers, pigments, dyes, antistatic agents, soil resists, stain resists, antimicrobial agents, and flame retardants.

The polymer is fed into an extruder in form of chips or granules, (indirect) melted and directed via jacketed Dowtherm ® (Dow Chemical, Midland Mich.) heated polymer distribution lines to the spinning head. The polymer melt is then metered by a high efficiency gear pump to spin pack assembly and extruded through a spinnerette with capillaries described below.

The spinnerette plate of the present invention has in general at least one multilobal opening, like tris-, tetra-, penta- or hexalobal capillary, preferably tri-and tetralobal capillary.

The capillary of the spinnerette plate of the present invention is described with reference to FIG. 2 for a trilobal opening:

Lobes (1), (2) and (3) have two ends each, (4), (5); (4), (6) and (4), (7). On one end (4) the lobes are connected to each other and radiating outwardly to the other end of each lobe (5), (6) and (7). The angles between the lobes (1), (2) and (3) are from about 100° to about 140°, preferably about 120°.

The projections (8), (9), (10); (11), (12), (13); (14), (15) and (16) alternate along the contour of each lobe, each projection radiating outwardly from a central portion of each lobe and having no counterpart on the opposite side of said lobe at said central portion. The number of projections per lobe are from about 2 to about 4, preferably 3.

The projections may be different in each lobe and may have different types of shapes like rectangular, square, triangular or round. Preferred is one type of shape in one spinnerette and is the rectangular or square shape.

Figure 3:
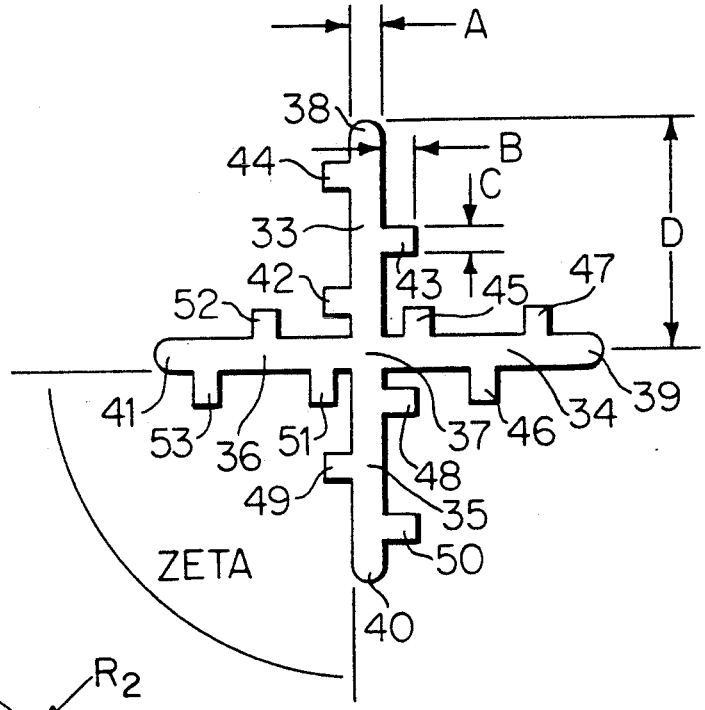
FIG. 3 is a front view of a tetralobal spinnerette capillary of the present invention comprising three alternating projections along the contour of each lobe.

The tetralobal opening in the spinnerette plate according to FIG. 3 has four lobes (33), (34), (35) and (36). On one end (37) the lobes are connected to each other, the other end of each lobe (38), (39), (40) and (41) radiating outwardly. The angles between the lobes (38), (40) and (41) are from about 80° to 100°, preferably about 90°.

The projections (42), (43), (44); (45), (46), (47); (48), (49), (50) and (51), (52) and (53) alternate along the contour of each lobe. The number of projections are from about 2 to about 4, preferably 3.

The dimensions of the different parts and their relationship to each other of the capillary of the present invention are as follows:

A is the width of the lobe

B is the width of the projection

C is the length of the projection

D is the length of the lobe

The dimensions A, B, C and D satisfy the following mathematic relationship:

$1.4 \leqq ((1.73\ D) / A)^{\frac{1}{2}} \leqq 49$;

preferably $6.3 \leqq ((1.73\ D) / A) \leqq 30.3$;

$0.5A \leqq B \leqq 2A$; and $0.5A \leqq C \leqq 2A$.

The length in mm of A and B may be:

$0.04\ mm \leqq A \leqq 0.15\ mm$, and $0.06\ mm \leqq D \leqq 3\ mm$.

The angle zeta between two respective lobes of the trilobal capillary is from about 70° to about 140°, preferably from about 110° to about 130° and most preferred approximately 120°.

The angle zeta between two respective lobes of the tetralobal capillary are from about 70° to about 140°, preferably from about 80° to about 100° and most preferred approximately 90°.

The disclosed dimensions are dependent from for example polymer type, spinning temperature, melt viscosity of the polymer and quench medium.

The desired "modification ratio" for the resulting filaments is also an important factor. By the term, "modification ratio" (MR), it is meant the ratio of the radius of a circle which circumscribes the filament cross-section to the radius of the largest circle which can be inscribed within the filament cross-section.

Figure 3A:
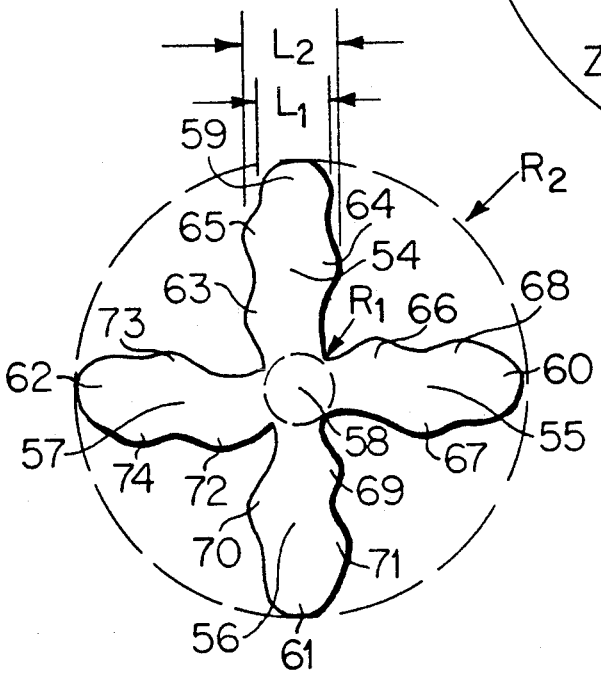
FIG. 3*a* is a cross-sectional view of a fiber spun by a spinnerette shown in FIG. 3.

The two circles are shown as dotted lines in FIG. 2*a* and FIG. 3*a*. The dimensions in the capillaries of the spinnerette plate are shown, that the MR for the cross-section of the resulting fiber is from about 1.2 to about 7, preferably from about 2.5 to about 5.

The respective polymer is extruded through the capillary of the spinnerette plate described in FIG. 2 or FIG. 3 to form a fiber having a cross-section described in FIG. 2*a* or FIG. 3*a*.

The trilobal cross-section of the fiber according to FIG. 2*a* has three lobes (17), (18) and (19) with two ends each (20), (21); (20), (22); and (20), (23).

On one end (20) the lobes are connected to each other, the other end of each lobe (21) (22) and 23 radiating outwardly.

The projections (24), (25), (26); (27), (28), (29) and (30), (31) (32) alternate along the contour of each lobe. According to the shape of the projections in the spinnerette, the projections of the cross section of the fiber differ slightly.

The tetralobal cross-section of the fiber according to FIG. 2(*a*) has four lobes (54), (55), (56) and (57) with two ends each (58), (59); (58), (60); (58) (61) and (58), (62).

On one end (58) the lobes are connected to each other and radiating outwardly to the other end of each lobe (59), (60), (61) and (62).

The lobes and diameters of the fiber of the present invention satisfy the following mathematical relationships:

L1 is the narrowest width of the lobe;

L2 is the widest width of the lobe;

R1 is the inner fiber diameter: and

R2 is the outer fiber diameter.

The dimensions L1, L2, R1 and R2 satisfy the following relationship:

$1.2 < R2/R1 \leqq 7.0$; preferably $2.5 \leqq R2/R1 \leqq 5.0$;

$1.1\ L1 \leqq L2 \leqq 5\ L1$; and $L1 \leqq L2 \leqq R1$.

The spinnerette plate of the present invention has from about 5 to about 300 openings in form of the capillaries, described above, preferably from about 10 to about 200.

The extruded fibers are quenched for example with air in order to solidify the fibers. The fibers are then treated with a finish comprising a lubricating oil or mixture of oils and antistatic agents. The fibers are then combined to form a yarn bundle which is then wound on a suitable package.

In a subsequent step, the yarn is drawn and texturized to form a bulked continuous filament (BCF) yarn suitable for tufting into carpets. A more preferred technique involves combining the extruded or as-spun filaments into a yarn, then drawing, texturizing and winding a package, all in a single step. This one-step method of making BCF is referred to in the trade as spin-draw-texturing.

Nylon fibers or filaments for the purpose of carpet manufacturing have deniers (denier = weight in grams of a single filament with a length of 9000 meters) in the range of about 3 to 75 denier/filament (dpf). A more preferred range for carpet fibers is from about 6 to 35 dpf.

From here, the BCF yarns can go through various processing steps well know to those skilled in the art. The fibers of this invention are particularly useful in the manufacture of carpets for floor covering applications.

To produce carpets for floor covering applications, the BCF yarns are generally tufted into a pliable primary backing. Primary backing materials are generally selected from the group comprising conventional woven jute, woven polypropylene, cellulosic nonwovens and nonwovens of nylon, polyester, and polypropylene. The primary backing is then coated with a suitable latex material such as conventional styrene-butadien latex, vinylidene chloride polymer, or vinyl chloride-vinylidene chloride copolymers. It is common practice to use fillers such as calcium carbonate to reduce latex costs. The final step is to apply a secondary backing, generally a woven jute or woven synthetic such as polypropylene.

EXAMPLES 1

Nylon 6 filaments were spun using three of the modified cross-section spinnerettes. Each spinnerette had 12 capillaries of a specific design of such as that in FIG. 2A with the following dimensions:

A = 0.08 mm

B = 0.08 mm

C = 0.08 mm

D = 0.96 mm

The angle zeta was 120°.

The nylon 6 polymer (rel. viscosity RV = 2.7) used was a bright polymer and did not contain any delusterant. The polymer temperature was controlled at the pump block at about 265° C. ± 1° and the spinning throughput was 66.75 g/min per spinnerette.

The molten fibers were quenched in a chimney using 80 ft/min air for cooling the fibers. The filaments were pulled by a feed roll rotating at a surface speed of 865 m/min through the quench zone and coated with a lubricant for drawing and crimping.

The yarns were combined and drawn at 1600 m/min and crimped by a process similar to that described in U.S. Pat. No. 4,095,317 to form 1100 denier 60 filament yarn.

The spun, drawn, and crimped yarns (BCF) were cable-twisted to a 3.5 turns per inch (tpi) on a cable twister and heat-set on a Superba heat-setting machine at the standard conditions for nylon 6 BCF yarns.

The test yarns were then tufted into 32 oz/sq. yd., 3/16 gauge cut pile contructions. The test carpets were compared with carpets made from production machines running nylon 6 BCF carpet yarns in a one-step and two-step process.

The carpet properties were assessed by a panel of experts and the results are shown in table 1.

TABLE 1

| yarns | cross-section | luster | bulk |
|---|---|---|---|
| 1. control, two-step | 3.2 MR trilobal | high | medium-high |
| 2. control, one step | 3.2 MR trilobal | high | medium |
| 3. Example 1 | 5.0 MR trilobal | low | medium-high |

MR: modification ratio

EXAMPLE 2

Nylon 6 (RV=2.7) filaments were spun using three of the modified cross-section spinnerettes using the above-described process for the main extruder and with a sidearm extruder attached to the main extruder. The sidearm extruder was fed with a nylon 6 polymer blended with color concentrates to produce yarns of red, blue, and green colors.

The polymer temperature was controlled at the pumpblock at about 265° C. and the spinning throughput was 55.0 g/min per spinnerette.

The filaments were drawn on a drawtwister at a draw ratio of 3:10 to a final denier of 220/12 filament and combined on an air texturing machine. A yarn with a denier of 200/35 filament was used as the core yarn and the green, red, and blue yarns were used as accent yarns and textured to give a space-dye look in carpet.

The carpets were 25 oz level loop and were compared to carpets made by the same process using the same blends of colors. The comparative carpets were using a trilobal cross-section yarn drawn to a final denier of 220/14 filament. Results are shown in table 2.

TABLE 2

| yarns | cross-section | texture |
|---|---|---|
| 1. Control | round | fair |
| 2. Control | 2.6 MR trilobal | good |
| 3. Example 2 | 4.6 MR trilobal | good |

MR: modification ratio

I claim:

1. A spinnerette plate for the manufacture of multilobal fibers comprising at least one opening having a plurality of lobes, each lobe having two ends, one end being connected to the other lobes, the other end of each of said lobes radiating outwardly and each lobe having a plurality of projections alternating along the contour of each lobe, each projection radiation outwardly from a central portion of each lobe and having no counterpart on the opposite side of said lobe at said central portion.

2. The spinnerette plate according to claim 1, wherein said opening has three lobes.

3. The spinnerette plate according to claim 1, wherein said opening has four lobes.

4. The spinnerette plate according to claim 1, wherein the dimensions of said capillary opening satisfy the following mathematical relationship:

$1.4 \leqq (1.73\ D/A)^{\frac{1}{2}} \leqq 49$;

$0.5A \leqq B \leqq 2A$;

$0.5A \leqq C \leqq 2A$; wherein

A is the width of the lobe;

B is the width of the projection;

C is the length of the projection; and

D is the length of the lobe.

5. The spinnerette plate according to claim 2, wherein $6.3 \leqq 1.73\ D/A \leqq 30.3$;

$0.5A \leqq B \leqq 2A$; and $0.5A \leqq C \leqq 2A$.

6. The spinnerette plate according to claim 1, wherein $0.04\ mm \leqq A \leqq 0.15\ mm$ and $0.06\ mm \leqq D \leqq 3\ mm$.

7. The spinnerette plate according to claim 2, wherein an angle zeta between two respective lobes is from about 70° to about 140°.

8. The spinnerette plate according to claim 7, wherein the angle zeta is from about 110° to about 130°.

9. The spinnerette plate according to claim 8, wherein the angle zeta is approximately 120°.

10. The spinnerette plate according to claim 3, wherein an angle zeta between two respective lobes is from about 70° to about 140°.

11. The spinnerette plate according to claim 9, wherein the angle zeta is from about 80° to about 100°.

12. The spinnerette plate according to claim 11, wherein the angle zeta is approximately 90°.

13. The spinnerette plate according to claim 1, having three projections alternating along the contour of each lobe.

14. The spinnerette plate according to claim 1, wherein the projections are rectangular.

15. The spinnerette plate according to claim wherein the projections are square.

16. The spinnerette plate according to claim 1, wherein the projections are triangular.

17. The spinnerette plate according to claim 1, wherein the projections are round.

* * * * *